US008277571B2

(12) United States Patent
Didat

(10) Patent No.: US 8,277,571 B2
(45) Date of Patent: Oct. 2, 2012

(54) METHODS AND APPARATUS FOR DETECTING PUMP CAVITATION IN A DISHWASHER USING FREQUENCY ANALYSIS

(75) Inventor: Mark Anthony Didat, Louisville, KY (US)

(73) Assignee: General Electric Company, Schenectady, NY (US)

( * ) Notice: Subject to any disclaimer, the term of this patent is extended or adjusted under 35 U.S.C. 154(b) by 32 days.

(21) Appl. No.: 12/861,903

(22) Filed: Aug. 24, 2010

(65) Prior Publication Data

US 2012/0048302 A1 Mar. 1, 2012

(51) Int. Cl.

| | |
|---|---|
| ***B08B 7/04*** | (2006.01) |
| ***B08B 9/20*** | (2006.01) |
| ***B08B 3/00*** | (2006.01) |

(52) U.S. Cl. ..... 134/56 D; 134/18; 134/25.2; 134/57 D; 134/58 D

(58) Field of Classification Search ..... 134/25.2, 134/18, 56 D, 57 D, 58 D, 56 R, 57 R, 58 R
See application file for complete search history.

(56) References Cited

U.S. PATENT DOCUMENTS

| | | | | |
|---|---|---|---|---|
| 5,669,095 | A * | 9/1997 | Dausch et al. | 8/158 |
| 7,231,319 | B2 | 6/2007 | Dimino et al. | |
| 2007/0172360 | A1 * | 7/2007 | Teipen | 417/36 |
| 2008/0115295 | A1 * | 5/2008 | Vadakkeveedu et al. | 8/159 |
| 2008/0120790 | A1 * | 5/2008 | Ashrafzadeh et al. | 8/159 |
| 2010/0275953 | A1 * | 11/2010 | Orue Orue et al. | 134/18 |

FOREIGN PATENT DOCUMENTS

| | | | |
|---|---|---|---|
| EP | 326893 | A2 * | 8/1989 |
| JP | 1045975 | A | 2/1989 |
| JP | 2008309023 | A | 12/2008 |

* cited by examiner

*Primary Examiner* — Alexander Markoff
(74) *Attorney, Agent, or Firm* — Global Patent Operation; Douglas D. Zhang

(57) ABSTRACT

Water fill level detection techniques are provided for a dishwasher system. A dishwasher system includes a tub; a fluid circulation system for circulating water in the tub and a controller. The fluid circulation system includes at least one motor and at least one fill valve. The controller monitors a current drawn by the motor to control an operation of the fill valve. The controller performs a frequency analysis on the current to detect a water fill level in the tub.

10 Claims, 7 Drawing Sheets

METHODS AND APPARATUS FOR DETECTING PUMP CAVITATION IN A DISHWASHER USING FREQUENCY ANALYSIS

BACKGROUND OF THE INVENTION

The present disclosure relates generally to dishwashers and, more particularly, to techniques for detecting a water fill level in dishwashers. A dishwasher is a mechanical device for cleaning dishes, utensils and other items. Various types of dishwashers are known and are currently available. Spray dishwashers, for example, spray warm water and detergent within a dishwasher cabinet to wash the items arranged in racks. Typically, the spray dishwasher employs one or more rotating spray arms that spray water through holes formed in the arms, a wash reservoir or "sump" where water is collected and a pump to pump the water from the sump to the spray arms.

A number of techniques have been proposed or suggested for reducing energy and water consumption in dishwashers. Existing water conservation techniques, for example, allow dishwashers to use less water while maintaining water velocity and pressure. One aspect of the known water conservation techniques attempt to only fill the dishwashers to an appropriate water fill amount.

Thus, a number of techniques exist for detecting a water fill level in dishwashers. For example, known techniques use timers or water resistance sensors to control the water fill level. Generally, when the pump motor stops cavitating there is an appropriate water fill amount in the dishwasher. One technique for monitoring the cavitation utilizes gradients of the current drawn by the pump motor to detect that the water pump has stopped cavitating. While this technique effectively detects an adequate water fill level, it requires a costly increase in the fine balance of the pump motor rotor so that software algorithms can identify current fluctuations due to cavitation. Otherwise, current fluctuations generated from an unbalanced rotor will cause an error in cavitation detection.

A need therefore exists for improved techniques for detecting a water fill level in dishwashers.

BRIEF DESCRIPTION OF THE INVENTION

As described herein, the exemplary embodiments of the present invention overcome one or more disadvantages known in the art. Generally, water fill level detection techniques are provided for a dishwasher system.

According to one aspect of the invention, a dishwasher system is provided that comprises a tub; a fluid circulation system for circulating water in the tub and a controller. The fluid circulation system comprises a motor and a fill valve. The controller monitors a current drawn by the motor to control an operation of the fill valve. The controller performs a frequency analysis on the current to detect a water fill level in the tub.

According to another aspect of the invention, a controller for a dishwasher system is provided. The controller comprises circuitry for sampling a current drawn by a motor in the dishwasher system; a signal processor to perform a frequency analysis on the current to detect a water fill level in the dishwasher system; and signal generating means for generating a water fill level signal to control an operation of at least one fill valve.

Another aspect of the invention provides a method for controlling an operation of a dishwasher system by sampling a current drawn by at least one motor in the dishwasher system; performing a frequency analysis on the current to detect a water fill level in the dishwasher system; and generating a water fill level signal to control an operation of at least one fill valve.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

The present invention provides improved techniques for detecting a water fill level in dishwashers. According to one aspect of the invention, an appropriate water fill level is detected by evaluating pump motor current fluctuations using a frequency spectrum analysis. As previously indicated, when the pump motor stops cavitating, there is an appropriate water fill amount in the dishwasher. Generally, the present invention recognizes that an unbalanced rotor will generate a very consistent frequency harmonic, while during cavitation the frequency harmonic will be more random. As discussed hereinafter, in one exemplary embodiment, the current drawn by the pump motor is sampled using current sampling hardware, and a Fast Fourier Transform (FFT) is performed on the sampled data to analyze the frequency spectrum and determine when the water level is full.

Figure 1:
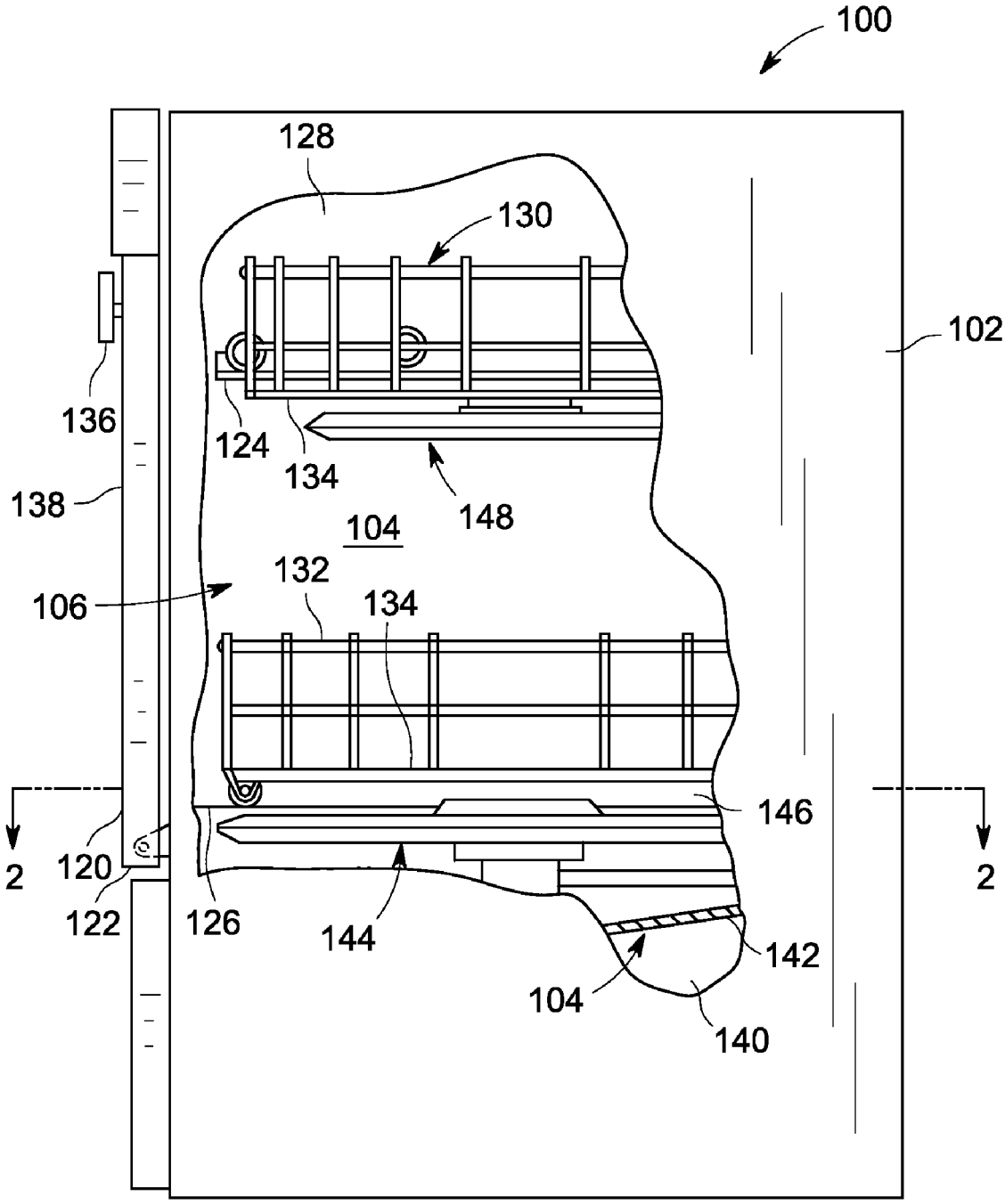
FIG. 1 is a side elevation view of an exemplary domestic dishwasher system partially broken away, and in which the present invention may be implemented.

FIG. 1 is a side elevation view of an exemplary domestic dishwasher system 100 partially broken away, and in which the present invention may be implemented. It is contemplated, however, that the invention may be practiced in other types of dishwashers and dishwasher systems other than just dishwasher system 100 described and illustrated herein. Accordingly, the following description is for illustrative purposes only, and the invention is not limited to use in a particular type of dishwasher system, such as dishwasher system 100.

Dishwasher 100 includes a cabinet 102 having a tub 104 therein and forming a wash chamber 106. Tub 104 includes a front opening (not shown in FIG. 1) and a door 120 hinged at its bottom 122 for movement between a normally closed vertical position (shown in FIG. 1) wherein the wash chamber 106 is sealed shut for washing operation, and a horizontal open position (not shown) for loading and unloading of dishwasher contents.

Upper and lower guide rails 124, 126 are mounted on tub side walls 128 and accommodate upper and lower roller-equipped racks 130, 132, respectively. Each of upper and lower racks 130, 132 is fabricated from known materials into lattice structures including a plurality of elongate members 134, and each rack 130, 132 is adapted for movement between an extended loading position (not shown) in which at least a portion of the rack is positioned outside wash chamber 106, and a retracted position (shown in FIG. 1) in which the rack is located inside wash chamber 106. Conventionally, a silverware basket (not shown) is removably attached to lower rack 132 for placement of silverware, utensils, and the like that are too small to be accommodated by upper and lower racks 130, 132.

A control input selector 136 is provided, for example, at a convenient location on an outer face 138 of door 120 and is coupled to known control circuitry (not shown) and control mechanisms (not shown) for operating a fluid circulation assembly (not shown in FIG. 1) for circulating water and dishwasher fluid in dishwasher tub 104. The fluid circulation assembly is located in a machinery compartment 140 located below a bottom sump portion 142 of tub 104, and its construction and operation is explained in detail below.

A lower spray-arm-assembly 144 is rotatably mounted within a lower region 146 of wash chamber 106 and above tub sump portion 142 so as to rotate in relatively close proximity to lower rack 132. A mid-level spray-arm assembly 148 is located in an upper region of wash chamber 106 in close proximity to upper rack 130 and at a sufficient height above lower rack 132 to accommodate items such as a dish or platter (not shown) that is expected to be placed in lower rack 132. In a further embodiment, an upper spray arm assembly (not shown) is located above upper rack 130 at a sufficient height to accommodate a tallest item expected to be placed in upper rack 130, such as a glass (not shown) of a selected height.

Lower and mid-level spray-arm assemblies 144, 148 and the upper spray arm assembly are fed by the fluid circulation assembly, and each spray-arm assembly includes an arrangement of discharge ports or orifices for directing washing liquid onto dishes located in upper and lower racks 130, 132, respectively. The arrangement of the discharge ports in at least lower spray-arm assembly 144 results in a rotational force as washing fluid flows through the discharge ports. The resultant rotation of lower spray-arm assembly 144 provides coverage of dishes and other dishwasher contents with a washing spray. In various alternative embodiments, mid-level spray arm 148 and/or the upper spray arm are also rotatably mounted and configured to generate a swirling spray pattern above and below upper rack 130 when the fluid circulation assembly is activated.

Figure 2:
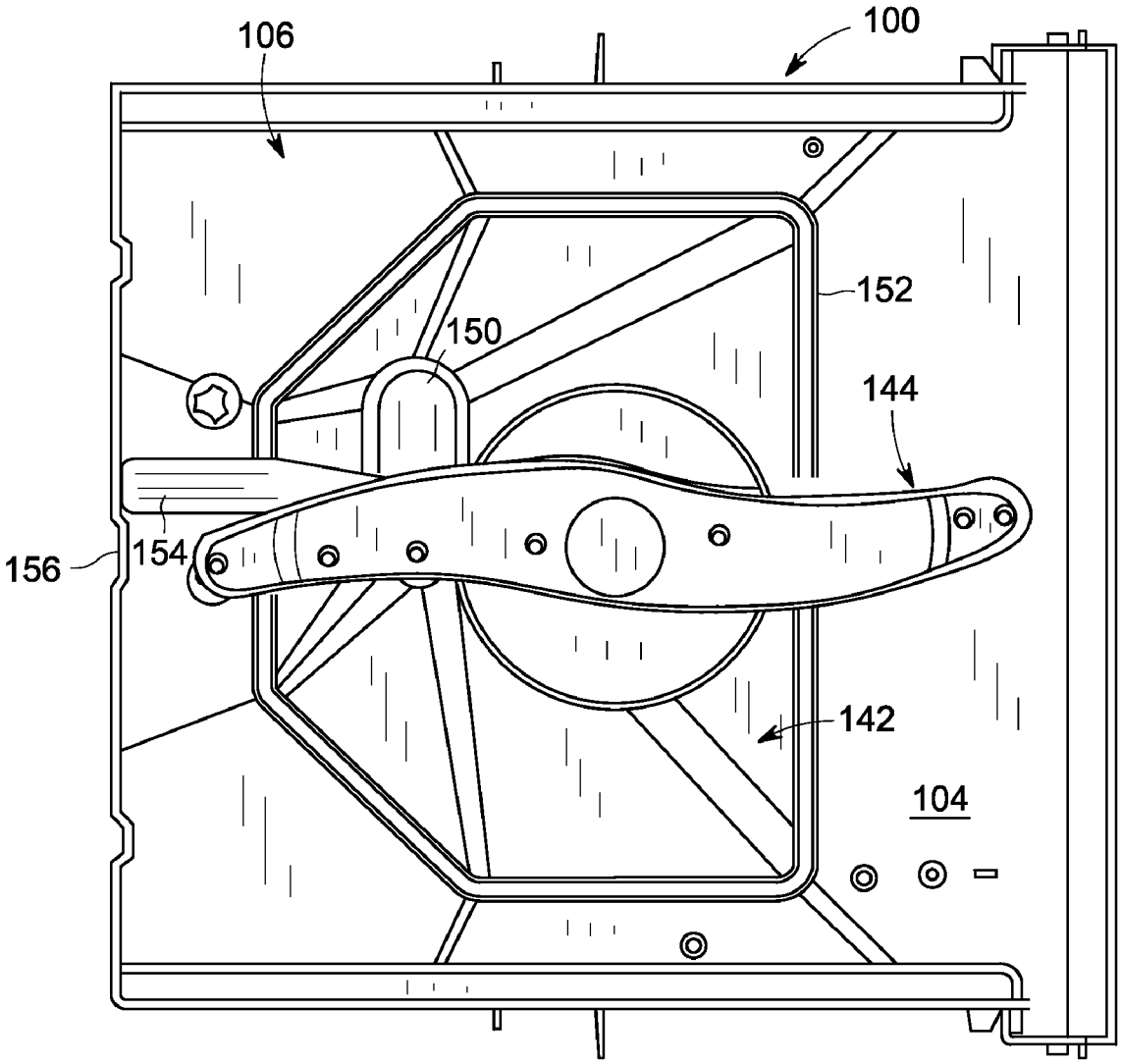
FIG. 2 is a top plan view of the dishwasher system of FIG. 1 along line 2-2.

FIG. 2 is a top plan view of the dishwasher system 100 just above lower spray arm assembly 144. Tub 104 is generally downwardly sloped beneath lower spray arm assembly 144 toward tub sump portion 142, and tub sump portion 142 is generally downwardly sloped toward a sump 150 in flow communication with the fluid circulation assembly (not shown in FIG. 2). Tub sump portion 142 includes a six-sided outer perimeter 152. Lower spray arm assembly is substantially centered within tub 104 and wash chamber 106, off-centered with respect to tub sump portion 142, and positioned above tub 104 and tub sump portion 142 to facilitate free rotation of spray arm 144.

Tub 104 and tub sump portion 142 are downwardly sloped toward sump 150 so that water sprayed from lower spray arm assembly 144, mid-level spray arm assembly 148 (shown in FIG. 1) and the upper spray arm assembly (not shown) is collected in tub sump portion 142 and directed toward sump 150 for filtering and re-circulation, as explained below, during a dishwasher system wash cycle. In addition, a conduit 154 extends beneath lower spray arm assembly 144 and is in flow communication with the fluid circulation assembly. Conduit 154 extends to a back wall 156 of wash chamber 106, and upward along back wall 156 for feeding wash fluid to mid-level spray arm assembly 148 and the upper spray arm assembly.

Figure 3:
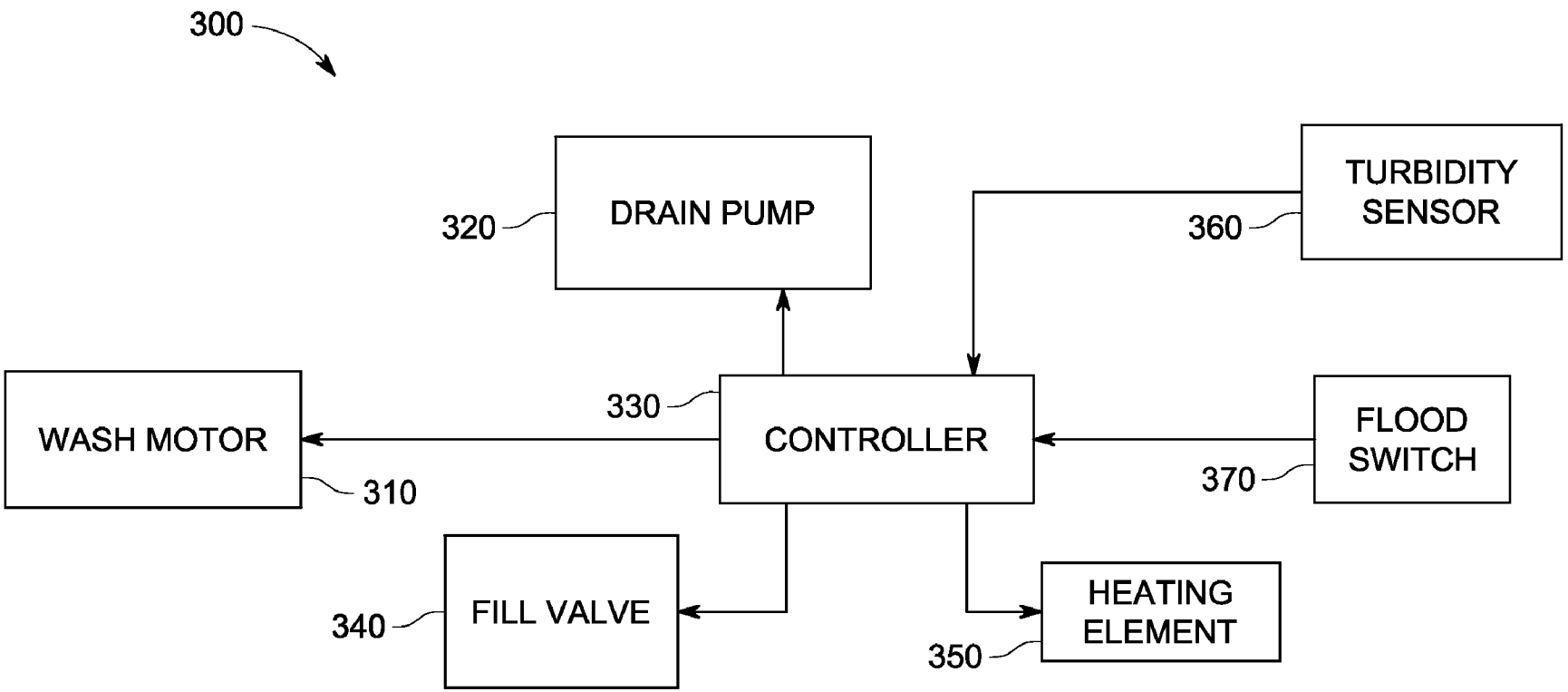
FIG. 3 is a schematic block diagram of an exemplary control system for the dishwasher system of FIG. 1.

FIG. 3 is a schematic block diagram of an exemplary control system 300 for the dishwasher system 100 of FIG. 1. As shown in FIG. 3, the exemplary control system 300 comprises a wash motor 310, a drain pump 320, a controller 330, a fill valve 340, a heating element 350, a turbidity sensor 360 and a flood switch 370, in a known manner. Generally, the wash motor 310 runs a pump that recirculates the water and dishwasher fluid in dishwasher tub 104. The current drawn by the wash motor 310 is monitored by the present invention to determine when an appropriate water fill level has been reached.

The drain pump 320 comprises a small pump that drains water from the dishwasher system 100. The exemplary controller 330 energizes the fill valve 340 to add water to the dishwasher system 100. As previously noted, adequate water needs to be added to the dishwasher system 100 for proper wash performance. As discussed further below in conjunction with FIGS. 6 and 7, the exemplary controller 330 employs current sense circuitry 600 to sense the current drawn by the wash motor 310 and employs one or more water fill level detection processes 700 to analyze the current and detect the water fill level in accordance with the present invention.

In one exemplary embodiment, the fill valve 340 is a solenoid valve that turns the water supply on and off. The heating element 350 can be implemented, for example, using a tubular heating element, such as a Calrod™, to heat the water in the dishwasher system 100 and thereby increase the cleaning performance. The exemplary turbidity sensor 360 senses the cleanliness of the water, in a known manner. Finally, the flood switch 370 comprises a flood protection float switch that interrupts power to the fill valve to prevent flooding of the home in the event of a failure.

Figure 4:
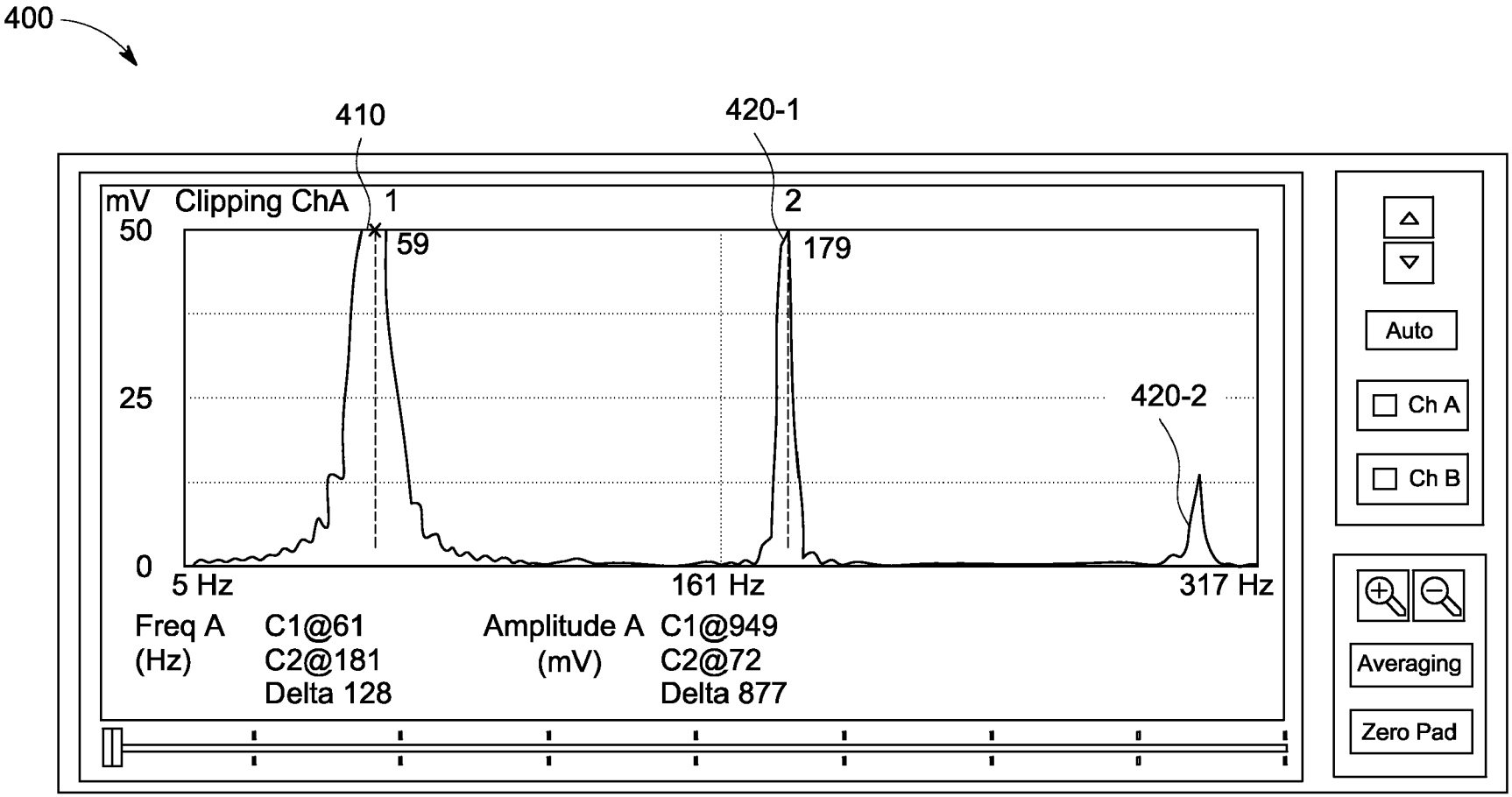
FIG. 4 illustrates a frequency response of the motor of FIG. 3 prior to a sufficient water fill level being reached.

FIG. 4 illustrates a frequency response 400 of the wash motor 310 of FIG. 3 prior to a sufficient water fill level being reached. During initial stages of the water fill process, the wash motor 310 effectively spins with no load. As shown in FIG. 4, the frequency response 400 comprises a magnitude peak 410 at the fundamental frequency, such as 60 Hz, and magnitude peaks 420-1, 420-2 at the harmonics of the fundamental frequency, such as 180 Hz and 300 Hz, respectively. When the current source is 60 Hz, for example, the wash motor 310 typically spins during the fill process at a consistent rate of approximately 3,600 revolutions per minute (RPM).

The present invention recognizes that when a sufficient water fill level is reached, the wash motor 310 operates under a load and will slow down. This condition is often referred to as the wash motor 310 being primed. Thus, as the sufficient water fill level is reached, the wash motor 310 will typically slow down in the presence of the load, for example, to rates below 3,600 RPM, to rates in the range of 3,100-3,200 RPM, for an exemplary current source of 60 Hz.

Figure 5:
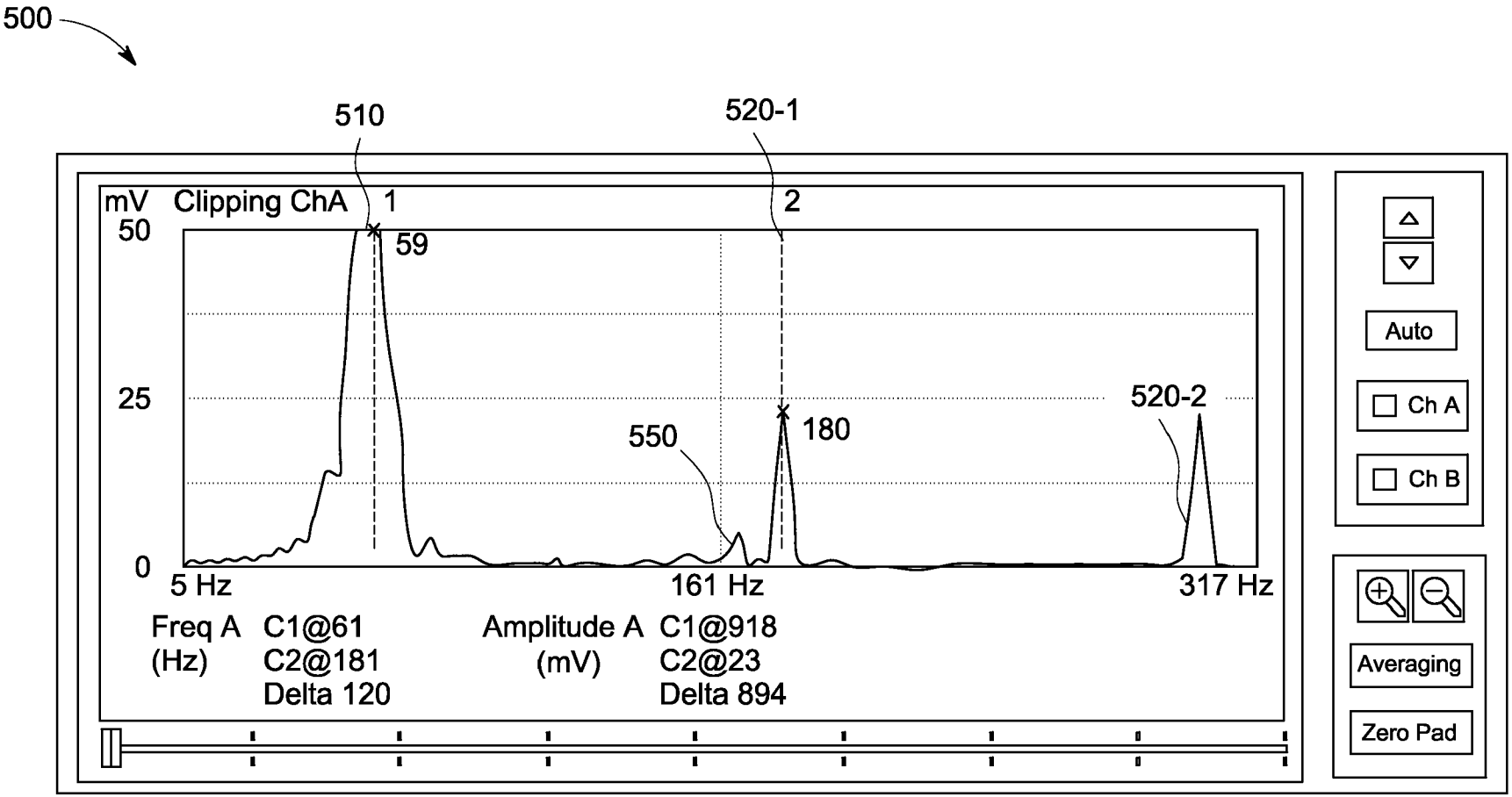
FIG. 5 illustrates a frequency response of the motor of FIG. 3 when a sufficient water fill level is reached.

FIG. 5 illustrates a frequency response 500 of the wash motor 310 of FIG. 3 when a sufficient water fill level is reached. As shown in FIG. 5, the frequency response 500 comprises a magnitude peak 510 at the fundamental frequency, such as 60 Hz, and magnitude peaks 520-1, 520-2 at the harmonics of the fundamental frequency, such as 180 Hz and 300 Hz, respectively. In addition, the fundamental frequency and the harmonics will each have an additional sideband peak, such as the sideband peak 550 at a slip frequency, that results from the wash motor 310 spinning at a reduced rate (below 3600 RPM in the exemplary embodiment) in the presence of a load. As the sufficient water fill level is reached, the wash motor 310 will typically slow down in the presence of the load, for example, to rates below 3,600 RPM, to rates in the range of 3,100-3,200 RPM, for an exemplary current source of 60 Hz, thereby creating the sideband 550.

Figure 6:
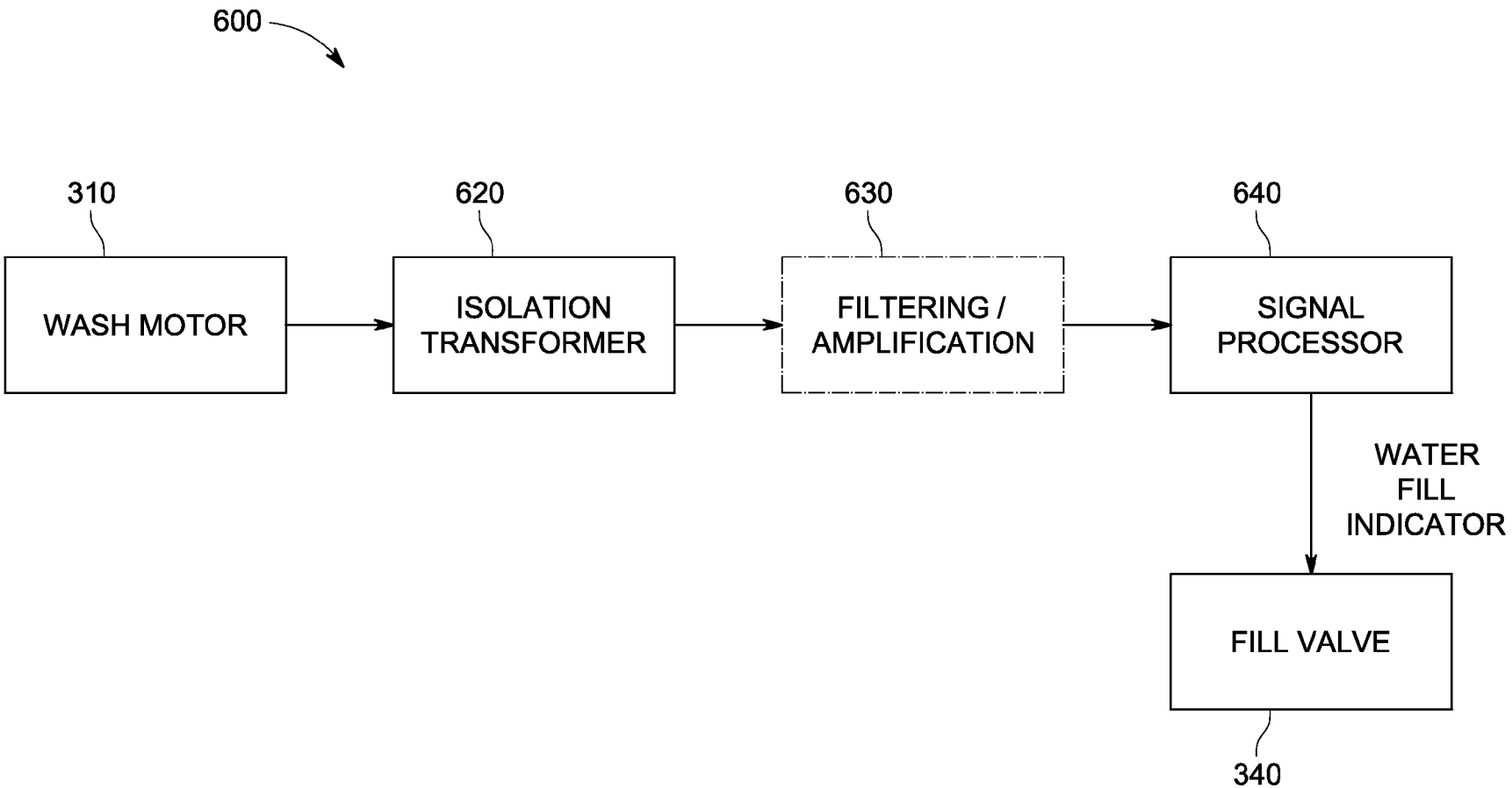
FIG. 6 is a schematic block diagram of exemplary current sense circuitry incorporating features of the present invention.

FIG. 6 is a schematic block diagram of exemplary current sense circuitry 600 incorporating features of the present invention. Generally, the current sense circuitry 600 monitors the current drawn by the wash motor 310, so that it can be analyzed in accordance with the present invention to detect the water fill level.

As shown in FIG. 6, the exemplary current sense circuitry 600 comprises an isolation transformer 620 connected to the wash motor 310 of FIG. 3. The output of the isolation transformer 620 is optionally applied to a filtering/amplification stage 630, prior to processing by a signal processor 640. The exemplary signal processor 640 implements one or more water fill level detection processes 700, discussed further below in conjunction with FIG. 7. Generally, when the water fill level detection process 700 determines that a sufficient water fill level has been reached, a water fill indicator signal is enabled and applied to the fill valve 340 of FIG. 3 to turn off the water supply.

Figure 7:
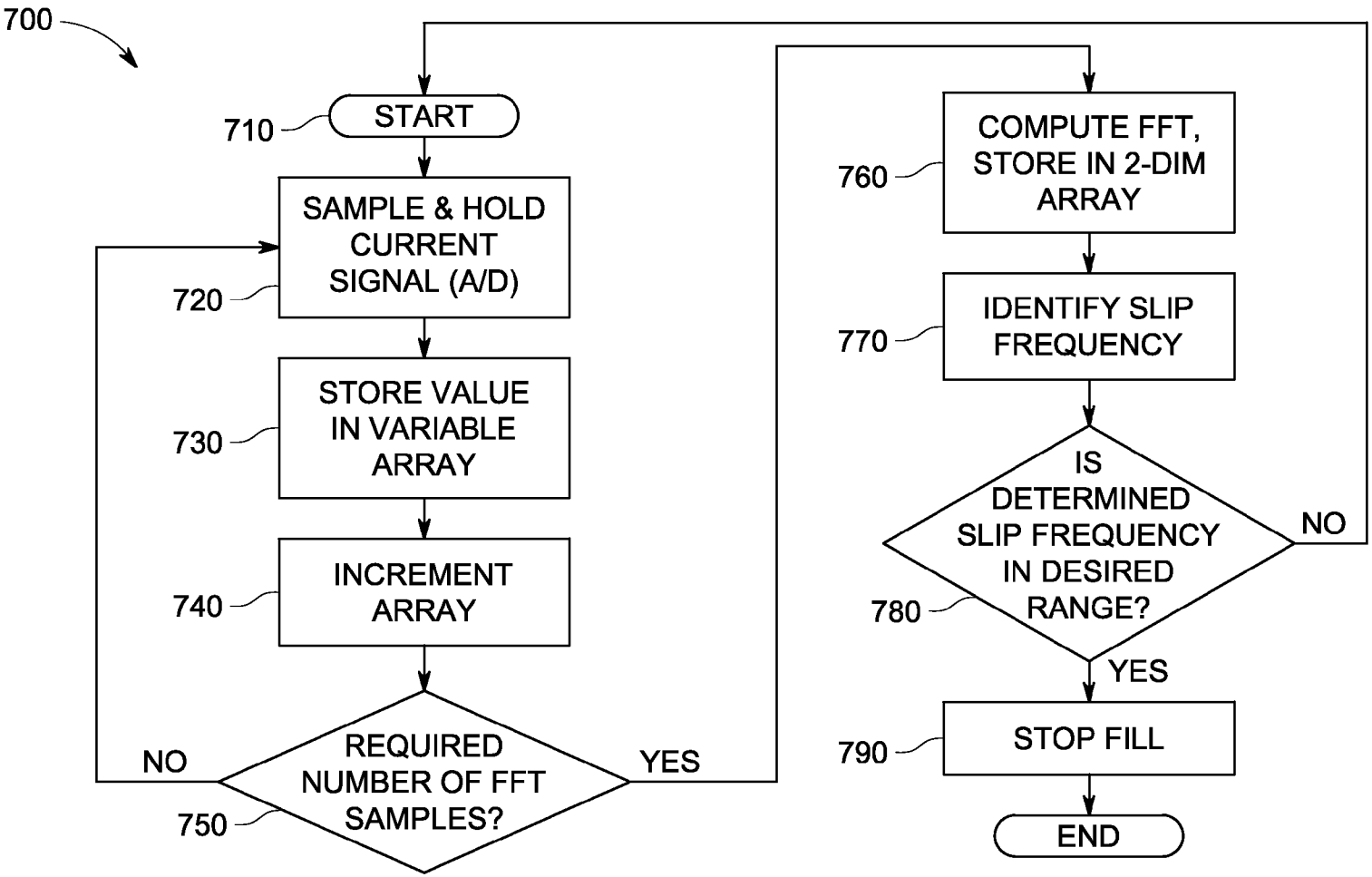
FIG. 7 is a flow chart describing an exemplary implementation of a water fill level detection process 700 incorporating features of the present invention.

FIG. 7 is a flow chart describing an exemplary implementation of a water fill level detection process 700 incorporating features of the present invention. The exemplary water fill level detection process 700 initially gathers the data samples that are required and then proceeds to analyze the data in the frequency domain using a Fast Fourier Transform technique.

As shown in FIG. 7, the exemplary water fill level detection process 700 is initiated during step 710. The water fill level detection process 700 initially performs a sample and hold operation on the current signal during step 720 to digitize the analog current. The sampled value is stored in a variable array during step 730 and an array counter is incremented during step 740.

A test is performed during step 750 to determine if the required number of Fast Fourier Transform samples has been reached. If it is determined during step 750 that the required number of Fast Fourier Transform samples has not been reached, then program control returns to step 720. If, however, it is determined during step 750 that the required number of Fast Fourier Transform samples has been reached, then program control proceeds to step 760.

During step 760, the exemplary water fill level detection process 700 computes the Fast Fourier Transform and stores the frequency response (e.g., magnitude as a function of frequency) in a two-dimensional array. The exemplary water fill level detection process 700 identifies the slip frequency 550 (FIG. 5) during step 770. For example, the slip frequency 550 can be identified by scanning the two-dimensional array for the largest magnitude that is not at the fundamental frequency (e.g., 60 Hz) or at a harmonic of the fundamental frequency.

A test is performed during step 780 to validate the slip frequency 550 by determining if the determined slip frequency is in a desired range. For example, if a rotational speed of 3100 RPM for the wash motor 310 is identified as the rotational speed that corresponds to the desired water fill level, then the slip frequency 550 should correlate to 3100 RPM. If the slip frequency 550 is not validated during step 780, then the exemplary water fill level detection process 700 is restarted and program control returns to step 710.

If, however, it is determined during step 780 that the determined slip frequency is valid, then program control proceeds to step 790, where the water fill indicator signal is enabled and applied to the fill valve 340 of FIG. 3 to turn off the water supply.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Obviously, modifications and alterations will occur to others upon reading and understanding the preceding detailed description. It is intended that the invention be construed as including all such modifications and alterations.

Thus, while there has been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A controller for a dishwasher system, comprising:

circuitry for sampling a current drawn by at least one motor in the dishwasher system;

a signal processor configured to perform a frequency analysis on the current to detect a water fill level in the dishwasher system based on at least one additional peak in a frequency response of the at least one motor relative to said frequency response prior to said water fill level being reached; and signal generating means for generating a water fill level signal to control an operation of at least one fill valve.

2. The controller of claim 1, wherein the frequency analysis performed by the signal processor comprises a Fast Fourier Transform (FFT).

3. The controller of claim 1, wherein the frequency analysis performed by the signal processor identifies a slip frequency of the at least one additional peak of the frequency response of the at least one motor.

4. The controller of claim 1, wherein the frequency analysis performed by the signal processor identifies a slip frequency of the at least one additional peak of the frequency response of the at least one motor, wherein the slip frequency is associated with a reduced rotational speed of the motor, relative to a rotational speed of the motor during a fill operation.

5. The controller of claim 1, wherein the frequency analysis performed by the signal processor identifies a frequency of the at least one additional peak having a substantially maximum magnitude, wherein the frequency is not one or more of a fundamental frequency and a harmonic of the fundamental frequency.

6. A dishwasher system comprising a controller, the controller comprising:

circuitry for sampling a current drawn by at least one motor in the dishwasher system;

a signal processor configured to perform a frequency analysis on the current to detect a water fill level in the dishwasher system based on at least one additional peak in a frequency response of the at least one motor relative to said frequency response prior to said water fill level being reached; and signal generating means for generating a water fill level signal to control an operation of at least one fill valve.

7. The dishwasher system of claim 6, wherein the frequency analysis performed by the signal processor comprises a Fast Fourier Transform (FFT).

8. The dishwasher system of claim 6, wherein the frequency analysis performed by the signal processor identifies a slip frequency of the at least one additional peak of the frequency response of the at least one motor.

9. The dishwasher system of claim 6, wherein the frequency analysis performed by the signal processor identifies a slip frequency of the at least one additional peak of the frequency response of the at least one motor, wherein the slip frequency is associated with a reduced rotational speed of the motor, relative to a rotational speed of the motor during a fill operation.

10. The dishwasher system of claim 6, wherein the frequency analysis performed by the signal processor identifies a frequency of the at least one additional peak having a substantially maximum magnitude, wherein the frequency is not one or more of a fundamental frequency and a harmonic of the fundamental frequency.

* * * * *